US006086007A

United States Patent [19]

Till

[11] Patent Number: 6,086,007

[45] Date of Patent: Jul. 11, 2000

[54] VISCOUSLY DAMPED CORD RETRACT

[75] Inventor: David Till, Cary, N.C.

[73] Assignee: Ericsson Inc., Research Triangle Park, N.C.

[21] Appl. No.: 09/088,301

[22] Filed: Jun. 1, 1998

[51] Int. Cl.[7] ..... B65H 75/30; B65H 23/04

[52] U.S. Cl. ..... 242/381; 242/396

[58] Field of Search ..... 242/381, 396, 242/422.2, 611, 611.1, 908; 33/413, 754, 767

[56] References Cited

U.S. PATENT DOCUMENTS 4,422,583 12/1983 Maxner et al. ..... 242/422.2

4,446,884 5/1984 Rader, Jr. .

*Primary Examiner*—John Q. Nguyen

*Attorney, Agent, or Firm*—Wood, Phillips, VanSanten, Clark & Mortimer

[57] ABSTRACT

A retractable system, apparatus, and method for dispensing, receiving, and storing flexible members are disclosed. The system, apparatus, and method are comprised of a spool, an air-damper member, and a house member. The spool is adapted to receive and store varying lengths of a flexible member. The air-damper member is concentrically disposed in the spool and defines at least two rotatable air filled chambers or channels. The house member secures the spool and the air-damper member in a concentric enclosed airy arrangement.

21 Claims, 6 Drawing Sheets

VISCOUSLY DAMPED CORD RETRACT

BACKGROUND OF THE INVENTION

The present invention relates to the field of retractable devices for ejecting and retracting flexible members and in particular to a system, apparatus, and method for regulating the engaging forces of retracting systems.

Retractable systems are often used to dispense, receive, and store flexible members. The flexible member which may be a wire, cable, rope, cord, hose, tube, chain, or tape measure, for example, is typically drawn from a storage enclosure to a length that is acceptable for use. When the flexible member is no longer needed, the member can be retracted and stored in the enclosure.

A variety of conventional storage retraction devices spirally wind and eject flexible members by employing spring driven spindles. Clockwise rotation of the spindle simultaneously ejects the flexible member from the enclosure while storing a retractile force in the spring driven system. When the flexible member is extended to an appropriate length, a tension control assembly is engaged allowing the flexible member to be used for its intended purpose. When the flexible member is ready to be stored, a modest draw on the flexible member usually releases the tension control assembly allowing the flexible member to recoil into the enclosure around the spindle.

The use of a spring drive in some retractable devices sometimes causes a random and disorderly recoil of the flexible member. As greater lengths of the flexible member are withdrawn from an enclosure, the spring driven system stores retraction energy proportional to the length of the flexible member ejected. The initial retraction of the flexible member subjects many storage retraction devices to a high rotational force. The transition from storing retraction forces to withdrawing the flexible member subjects these devices to a substantial transitional force that causes damage to some devices. The unregulated retraction of flexible members frequently occurs at an increasing velocity preventing a neat and orderly retraction. If the flexible member does not become tangled or damaged as it is recoiled, the increasing rotational velocity of the spindle may recoil the entire flexible member into the enclosure. When the flexible member is completely received by the enclosure, the flexible member may not be accessible and may damage the retracting device.

Some conventional retractable devices use fluid damper assemblies to limit the retraction velocity of the spindle. In these devices, a volume of liquid is subject to significant shear forces that result from the retraction of a substantial length of the flexible member. If the liquid seal is compromised, the retracting forces in such devices may not effectively damp the rotational velocity of the spindle subjecting the spindle and the flexible member to the unregulated recoil energy released by the spring driven system.

In light of the strengths and weaknesses of the conventional art, there is a need for a retractable system, apparatus, and method that regulates the engaging forces of retracting devices without relying on a fluid damper assembly. The system, apparatus, and method should be capable of providing a damping force proportional to the recoil velocity of the spindle, providing damping forces even if the damping assembly is compromised, and function in a compact modular assembly that is easy to manufacture, assemble, and store.

SUMMARY OF THE INVENTION

A retractable system, apparatus, and method for dispensing, receiving, and storing flexible members are disclosed. The system, apparatus, and method are comprised of a spool, an air-damper member, and a house member. The spool is adapted to receive and store varying lengths of a flexible member. The air-damper member is concentrically disposed in the spool and defines at least two rotatable air filled chambers or channels. The house member secures the spool and the air-damper member in a concentric enclosed airy arrangement.

In another embodiment of the invention, the retractable system, apparatus, and method is comprised of an air-damper member, a spool, a supporting member, and a house member. The air-damper member is positioned in a rotatable arrangement that allows a rotation in a first direction and a rotation in a second direction about an axis of rotation. The air-damper member is adapted to define a plurality of rotatable air filled channels. The spool is adapted to rotate the air-damper member when it rotates while the supporting member is adapted to support the air-damper member and the spool about the air-damper member and spool's axis of rotation. The house member encloses the air-damper member and the spool in an airy arrangement and is connected to the supporting member at a position that corresponds to the air-damper member and spool's axis of rotation.

DETAILED DESCRIPTION OF THE PRESENTLY PREFERRED EMBODIMENTS

Figure 1:
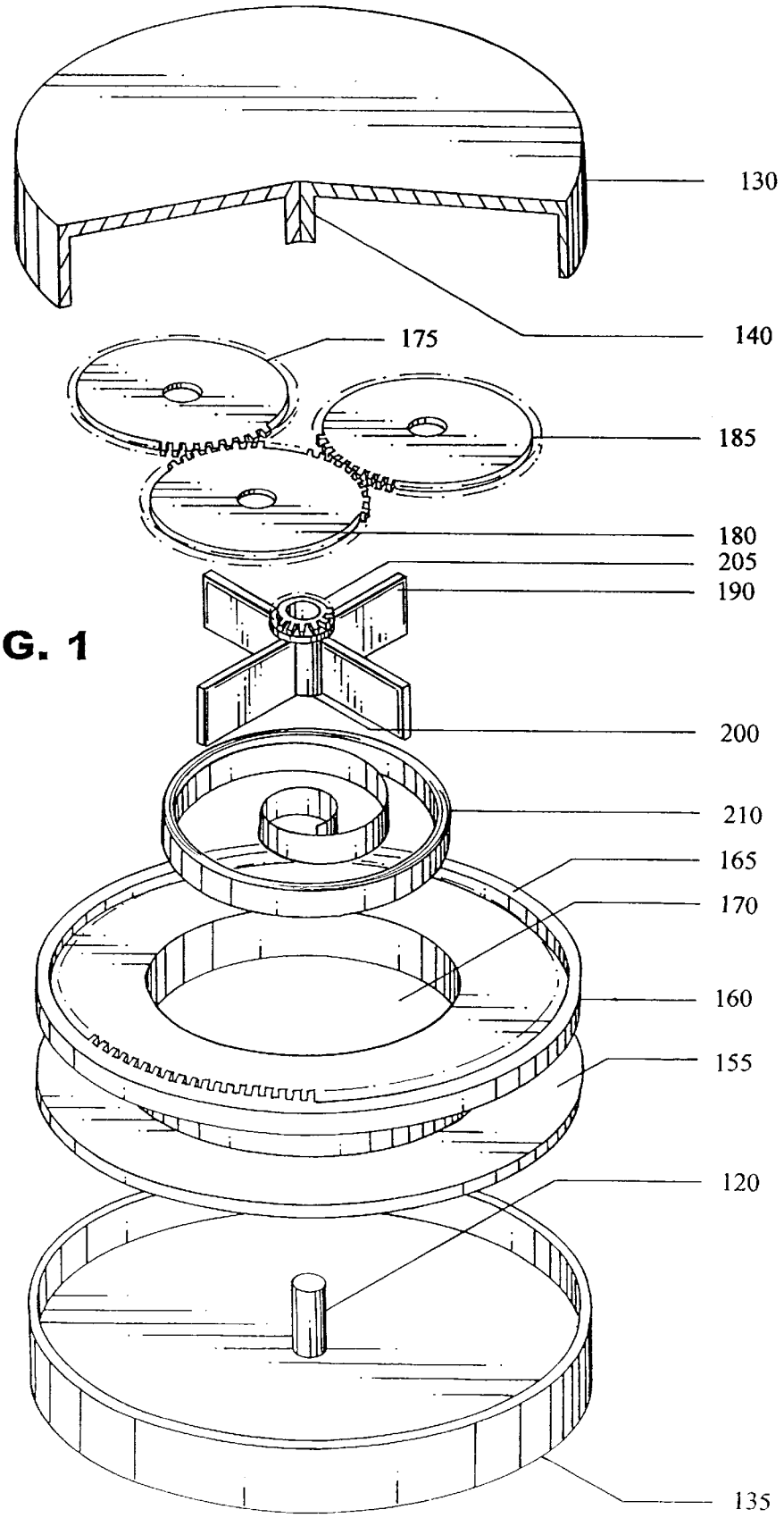
FIG. 1. is a exploded perspective view of an embodiment of the viscously damped cord retraction system.

In the drawings depicted elements are not necessarily drawn to scale and the same reference numbers through several views may designate alike and similar elements.

Referring to FIGS. 1–4, a viscously damped system 100 is illustrated. The system 100 has a spool 105, an air-damper member 110, a house member 115, and a supporting member 120. The house member 115 generally denotes a means for defining an enclosure and also includes housing of varying sizes and shapes that do not restrict the spool's 105 rotation. The spool 105 generally denotes a means for receiving a flexible member and includes other means such as reels and spindles. The air-damper member 110 generally denotes means for viscously air damping the rotation of said receiving means. The means supporting said receiving and damping means generally denotes the supporting member 120 which include any axial member capable of supporting the spool 105 and air-damper member 110 without restricting the spool's 105 rotation. A flexible member 125 generally denotes the means movable by a user which includes wires, cables, ropes, cords, hoses, tubes, chains, or tape measures, for example. An airy chamber describes an enclosure that is not open to a free circulation of air but is penetrable by a limited volume of air.

The house member 115 is of two piece construction having a top enclosure 130 and a bottom enclosure 135. The top enclosure 130 is joined to the bottom enclosure 135 in a substantially isometric engagement. A supporting member 120 rigidly couples the top enclosure 130 to the bottom enclosure 135. Of course, the top enclosure 130 and bottom enclosure 135 may also be joined directly or via one or more intermediate parts. As illustrated in FIG. 1, the supporting member 120 extends longitudinally from the bottom enclosure 130 to a slidable receiving sleeve 140 at a position corresponding to an axis of rotation of the spool 105 and the air-damper member 110. The bottom enclosure 135 also has a concentric bore 145 that preferably has smoothly rounded edges.

Figure 2:
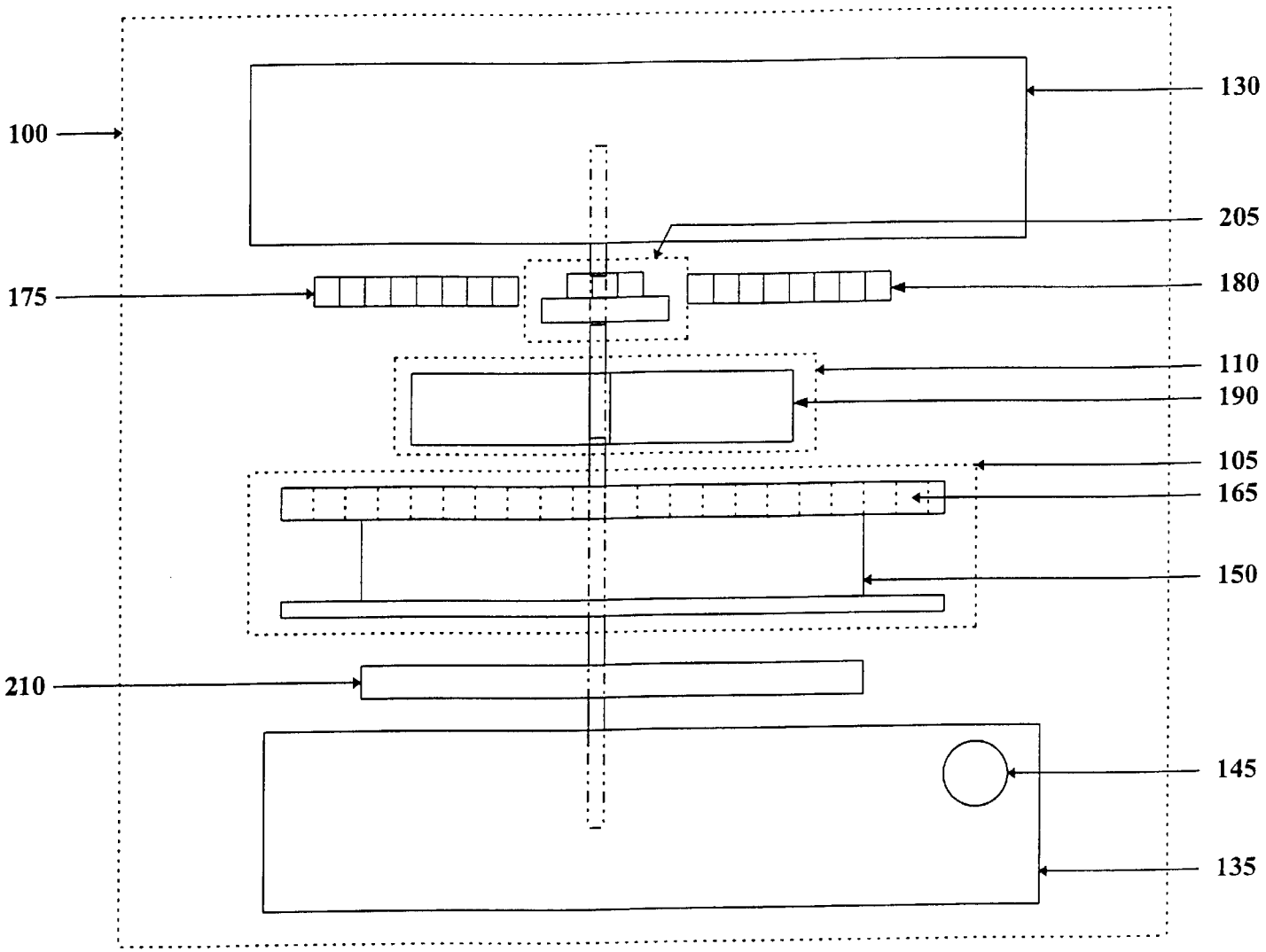
FIG. 2 is a front exploded view of the embodiment depicted in FIG. 1.

The spool 105 includes a receiving surface 150 recessed between a base plate 155 and an engaging plate 160. The base plate 155 rigidly attaches to the lower end of the receiving surface 150 to provide the spool 105 with a lower abutting surface. The engaging plate 160 rigidly attaches to the upper end of the receiving surface 150 to provide the spool 105 with an upper abutting surface and further embodies a hub gear 165 positioned above the spool 105. As illustrated in FIG. 2, the hub gear 165 has coupling teeth affixed to its inner diameter to engage a plurality of mating teeth that are securely attached to a plurality of idler gears 175, 180, and 185. The coupling teeth and mating teeth are proportionally positioned so that the degree of play between the teeth allow the gears to operate in either clockwise or counterclockwise rotations. The idler gears 175, 180, and 185 have less teeth than the hub gear 165. This difference causes the idler gears 175,180, and 185 to rotate at a higher velocity than the hub gear 165. The hub gear 165 and at least one idler gear 175 are the "internal gear assembly" of the system 100.

Again referring to FIGS. 1 and 2, the air-damper member 110 is illustrated. The air-damper member 110 includes a plurality of vanes 190 and a hub member 200. Similarly, an air-damper is any suitable structure having a plurality of vanes 190 and a hub. The plurality of vanes 190 extend from the hub member 200 to define a plurality of air filled rotatable chambers. Because the spool's 105 hollow hub 170 encloses the air-damper member 110, the air-damper member 110 is of sufficient height, depth, and width to fit in a limited concentric area that defines the hollow hub 170.

A pinion gear 205 is rigidly attached to the hub member 200 preferably at a position corresponding to the axis of rotation of the spool 105 and the air-damper member 110. Like the internal gear assembly, the pinion gear 205 is positioned in a plane transverse to the axis of rotation of the spool 105 and the air-damper member 110. The pinion gear 205 which has fewer clutching teeth on its outside diameter than the mating teeth of the idler gears 175,180, and 185 it engages, rotates at a higher velocity than the idler gears 175,180, and 185.

Figure 3:
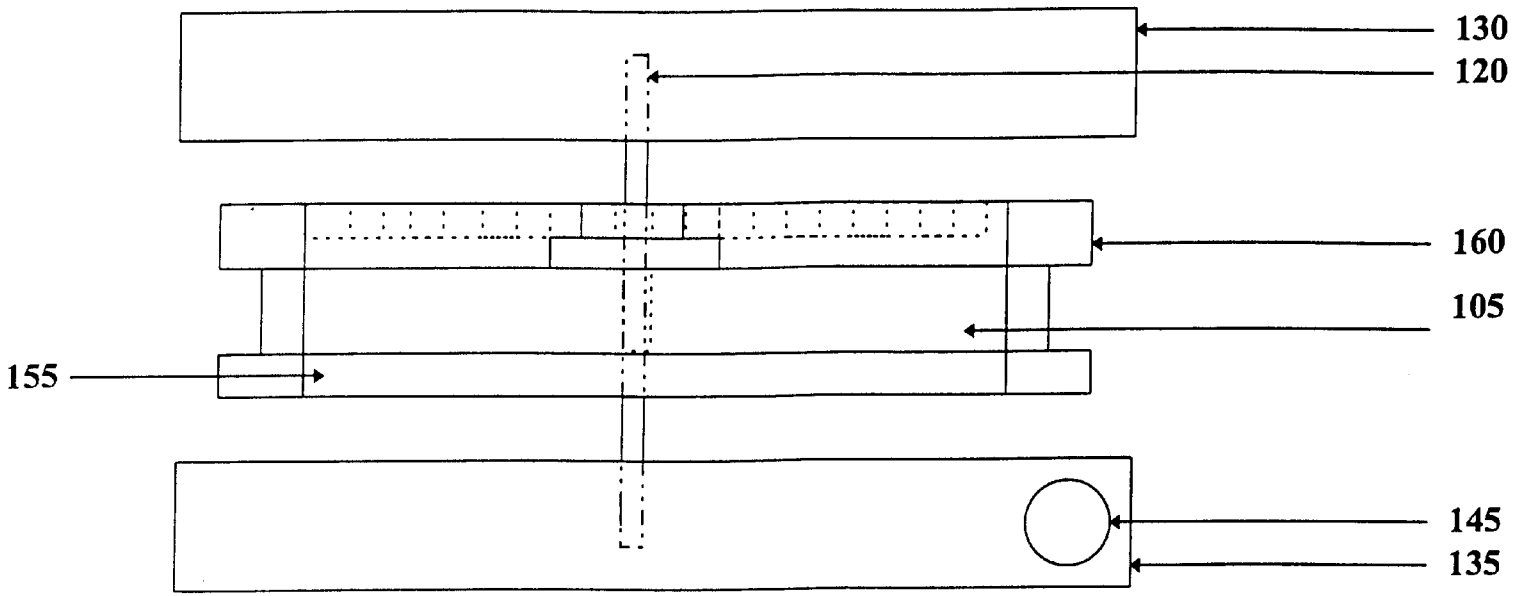
FIG. 3 is a front view of the partially assembled embodiment depicted in FIG. 1.

FIGS. 1 and 3 illustrate the recoiling system. A recoiling member 210 or spring is concentrically positioned about the supporting member 120. As illustrated in FIG. 1, a concentric recoiling member 210 having an interior and exterior end is disposed in the hollow hub 170. The interior end of the recoiling member 210 is rigidly coupled to the support member 120 while the exterior end of the recoiling member 210 engage a plurality of slotted recesses located on the interior surface of the hollow hub 170.

Figure 4:
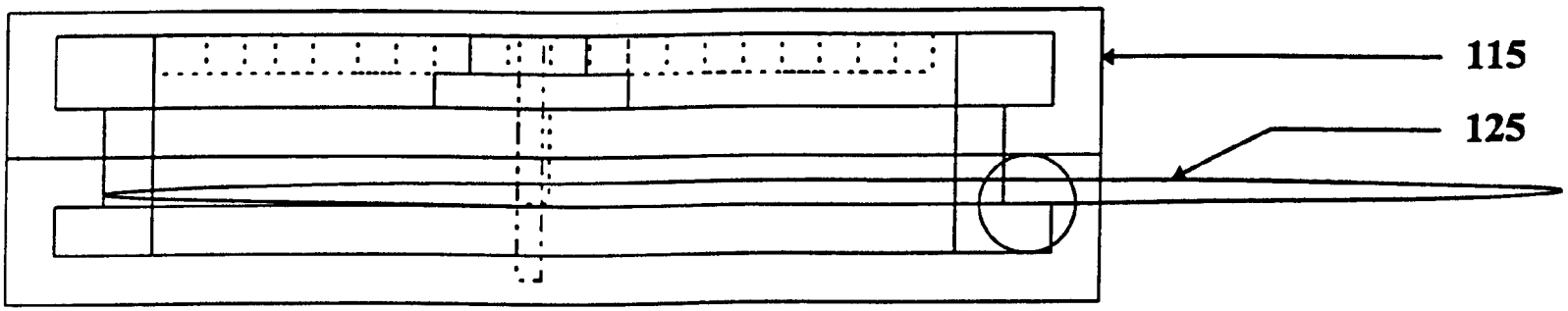
FIG. 4 is a front view of the assembled embodiment depicted in FIG. 1.

To assemble the viscously damped cord retraction system 100 for use, the spool is positioned on the bottom enclosure 135 so that it is concentrically aligned with the supporting member 120. The recoiling member 210 is then rigidly coupled to the supporting member 120 and positioned to engage one of the slotted recesses located on the interior surface of the hollow hub 170. The air-damper member 110 is then received by the supporting member 120 and positioned in the hollow hub 170 so that the pinion gear 205 is in a substantially horizontal plane of alignment with the idler gears 170,175,180 and hub gear 165. The top enclosure 130 is then attached to the supporting member 120, as illustrated in FIG. 4. A tension control assembly may be positioned in the system 100 to lock the spool 105 when the flexible member 125 is in use and release the spool 105 when the flexible member 125 is to be stored.

Operation of the system 100 occurs when a user engages the flexible member 125. If the user wishes to store the flexible member 125, the user releases the tension control assembly. The initial release of the tension control assembly induces a counterclockwise rotation of the spool 105. When the spool begins to turn, the hub gear 165, idler gears 175, 180, and 185, and pinion gear 205 convert the rotation of the spool 105 into a linear rotation of the air-damper member 110. The rotation of the air damping member 110 gives rise to a rotational frictional force that creates an opposing rotational torque that resists the rotational velocity of the spool 105. The magnitude of the opposing rotational torque is proportional to the rotational velocity of the spool 105 and the volume of air displaced by the air-damper member 110.

Figure 5:
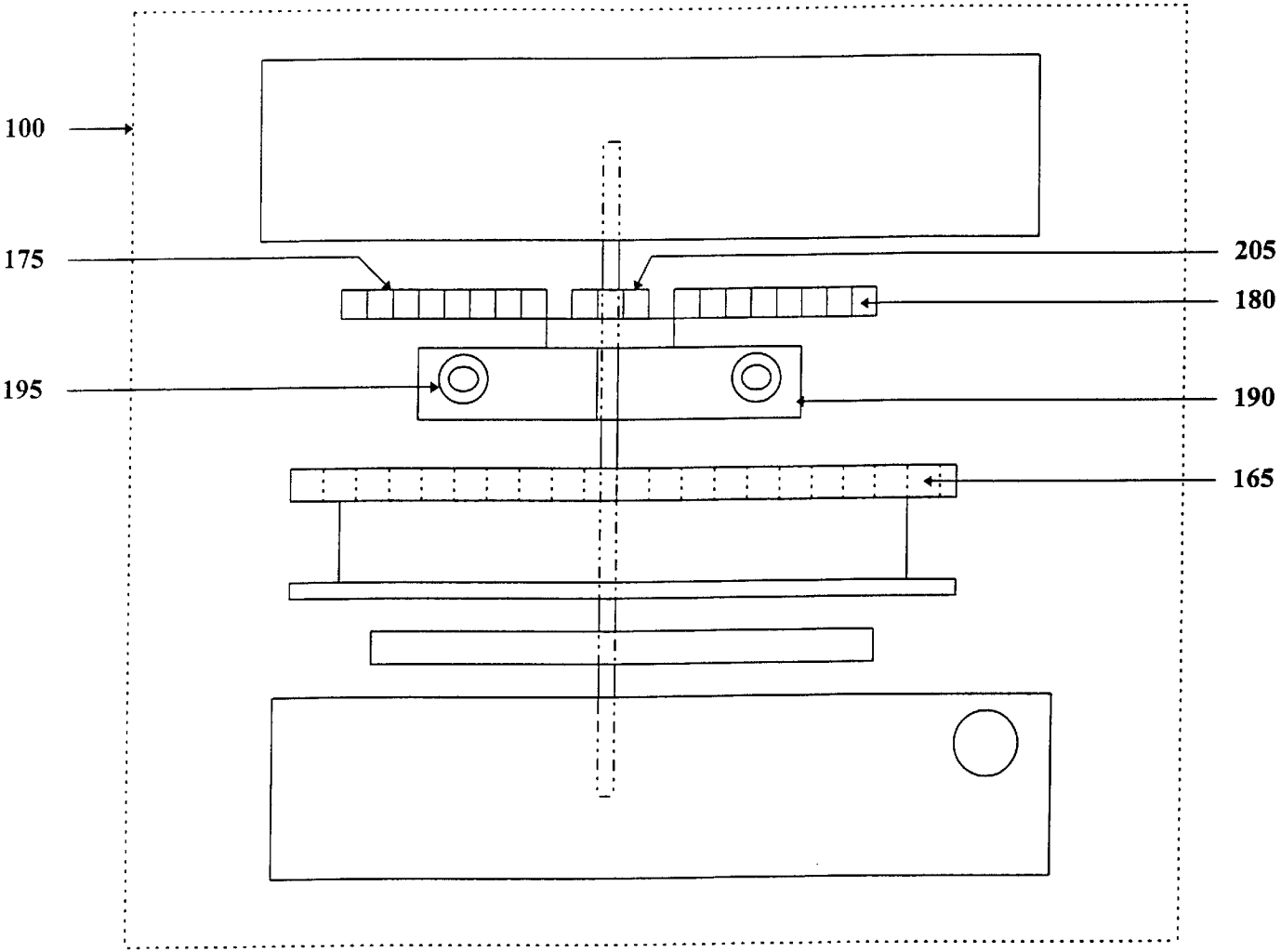
FIG. 5 is a front view of a second embodiment of the viscously damped cord retraction system.
Figure 6:
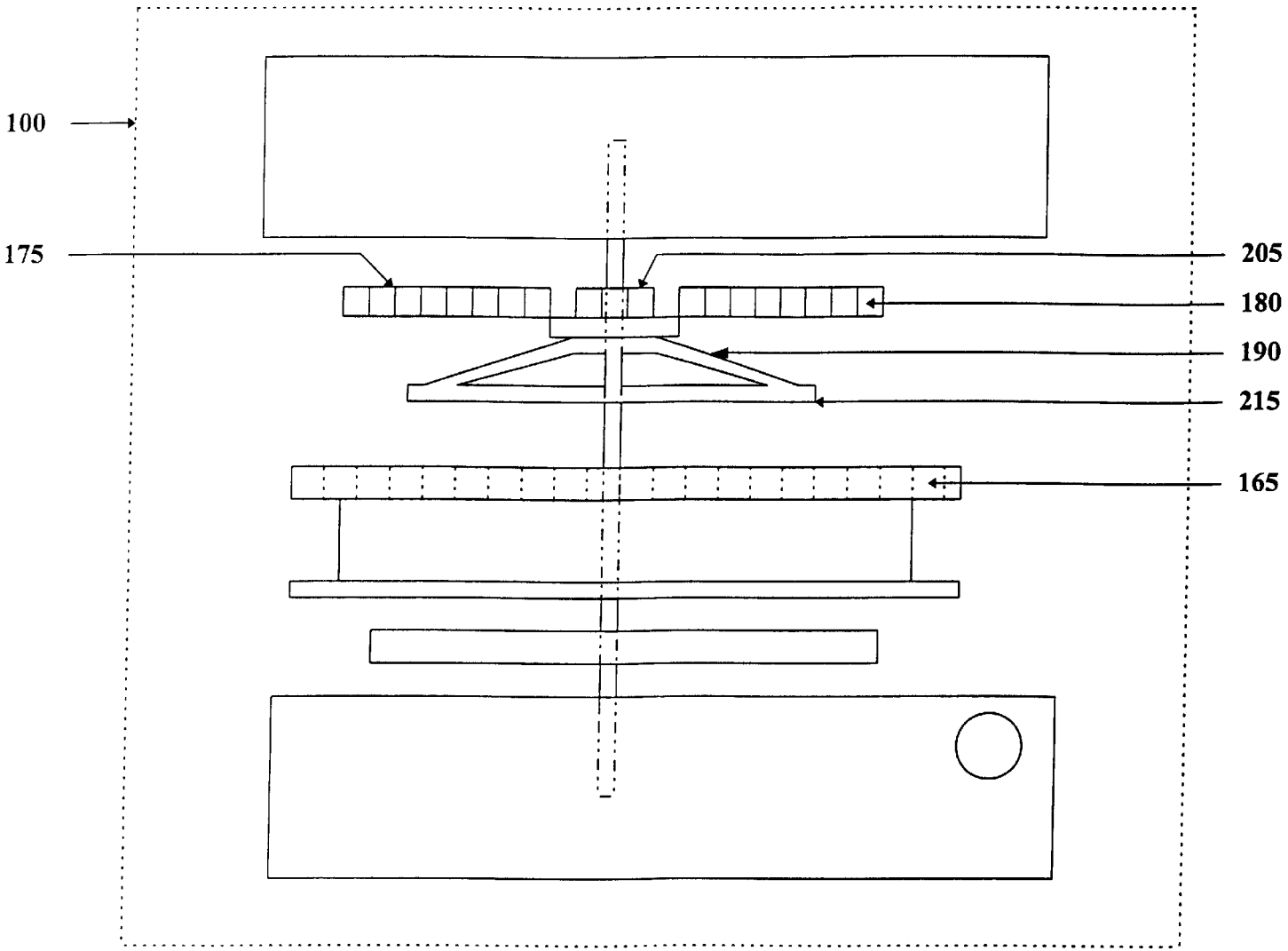
FIG. 6 is a front view of a third embodiment of the viscously damped cord retraction system.

Individuals skilled in the art will appreciate the wide array of structures that may be practiced in other embodiments. For instance, the vanes 190 that partially define the air-damper member 110 may be rigidly or flexibly attached to the hub member 200 in a twisted or linear arrangement forming a perpendicular or helical surface 215 as illustrated in FIGS. 2 and 6. Likewise, the vanes 190 may be fabricated of a resilient or flexible material and may take many forms such as having curved distal ends 195 as illustrated in FIG. 5. As this disclosure describes a compact system, it is further envisioned that the vanes 190 may engage the surface of the hollow hub 170 giving rise to a static or spin friction that further opposes the rotational velocity of the spool 105.

The viscously damped cord retraction system 100 is relatively easy to manufacture as the entire system 100 can be fabricated from injected molded parts, steel, or aluminum. The system 100 offers the advantages of providing a damping force proportional to the recoil velocity of the spindle 105, providing damping forces even if a vane 190 is broken or the damping assembly is compromised, and providing a system designed to function in a compact modular assembly. The disclosed embodiments enjoy utility in any cord retraction system.

Variations and modifications of the embodiments disclosed in this specification may be made without departing from scope and spirit of the invention. The aforementioned description is intended to be illustrative rather than limiting and it is understood that the scope of the invention is set forth by the following claims.

I claim:

1. A damped rotary line dispensing and retracting assembly comprising:

a spool;

a line of material taken up in coiled relation on said spool;

an air-damper concentrically disposed for rotation within said spool, said air-damper having at least one air-displacing vane;

a wind-up coil spring disposed within said spool for biasing the spool to take up said line of material;

a housing rotatable supporting said spool and said air-damper in an air chamber so that the rotation of said spool rotates said air-damper in resistance to a volume of air enclosed by said chamber; and means for rotatably coupling said spool and said air-damper so that the air damper rotates at an increased angular velocity with respect to the rotation of the spool when the spool rotates to retract said line.

2. The assembly of claim 1, wherein said housing secures said spool and said air-damper by a support member joined to said housing at a position corresponding to an axis of rotation of said spool and said air-damper.

3. The assembly of claim 1, wherein the air-damper further comprises a hub and a plurality of vanes extending therefrom and rotatable about an axis of rotation of said spool.

4. The assembly of claim 3, wherein distal ends of said vanes have a curved cup-shape.

5. The assembly of claim 3, wherein said plurality of vanes are coupled to said hub in a twisted arrangement so that the vanes form a helical surface that impels air.

6. The assembly of claim 3, wherein said plurality of vanes are constructed of a resilient material and flexibly coupled to said hub so that the tips of said vanes frictionally contact said spool as said vanes are rotated.

7. The assembly of claim 3, wherein said means for rotatably coupling includes an internal gear assembly positioned in a plane transverse to an axis of rotation of said spool and said air-damper that is structured to cause said air-damper to rotate at a faster rate than said spool.

8. The assembly of claim 7, wherein said internal gear assembly further comprises a plurality of circumferentially spaced gear teeth formed on a periphery surface of said spool and engagable with a plurality of gears rotatably coupled to said air-damper.

9. A cord retraction unit especially suitable for reducing rotational inertia using air, comprising:

an air-damper hub having an axis of rotation and at least one vane;

a spool taking up said cord and arranged to partially enclose said air-damper hub;

means rotatably coupling the air damper hub and spool so that said air-damper and spool rotate about said axis of rotation and so that the air-damper hub rotates at an increased angular velocity with respect to the rotation of the spool when the spool rotates to retract the cord;

a housing having a supporting member extending through said axis of rotation so that the rotation of said spool rotates said air-damper hub in resistance to a volume of air enclosed by said housing in an airy arrangement; and means for rotatably biasing said spool to take up said cord.

10. The cord retraction unit of claim 9, wherein the air-damper hub further comprises a plurality of vanes extending from the hub.

11. The cord retraction unit of claim 10, wherein said vanes have distal ends forming a curved shape.

12. The cord retraction unit of claim 10, wherein said vanes are coupled to said hub in a twisted arrangement that impels air.

13. The cord retraction unit of claim 10, wherein said vanes are constructed of a resilient material and flexibly coupled to said hub so that the tips of said vanes frictionally contact said spool as said vanes are rotated.

14. The cord retraction unit of claim 10, wherein said means for rotatably coupling includes an internal gear assembly positioned in a plane transverse to an axis of rotation of said spool and said air-damper hub so that the hub rotates at a faster rate than said spool.

15. The cord retraction unit of claim 14, wherein said internal gear assembly comprises an internal gear coupled to a periphery gear surface of said spool and wherein said internal gear cooperates with at least one gear rotatably coupled to said hub.

16. A method for extending and retracting a cord, comprising the steps of:

providing a spool with an axially aligned central cylindrical space and a peripheral support surface;

disposing a wind-up recoil spring in axial alignment with the spool in said cylindrical space;

providing a cord wound on the peripheral support surface of the spool;

rotationally biasing the spool with the cord in a fully wound-up position;

disposing a rotatable hub in axial alignment with the spring and spool within the cylindrical space of said spool;

providing at least one air-resisting vane extending from the hub and rotating with the hub;

rotatably coupling the hub and spool so that the hub and vane rotate at an increased angular velocity with respect to the rotation of the spool;

pulling and unwinding the cord from the spool against the return force of the recoil spring;

releasing the cord so that the cord winds up on the spool under the return force of the recoil spring; and rotating said at least one vane at said increased angular velocity and thereby dampening and slowing the retracting movement of the cord as the cord winds on the spool.

17. The method of claim 16, further including the steps of:

providing a pinion gear on said hub;

providing at least one idler gear rotatably engaging the pinion gear;

providing a hub gear on a peripheral surface of said spool;

rotatably engaging the idler and hub gears; and providing gear ratios that cause the rotation of the spool to be translated into a higher angular velocity rotation of the hub and vane which then dampen the rotation of the spool by air resistance against the vane.

18. The method of claim 16, further including the step of providing the at least one vane with a flat air-resisting surface.

19. The method of claim 16, further including the step of shaping the at least one vane with a curve to increase its air resistance.

20. The method of claim 16, further including the step of making said at least one vane of a resilient material and extending an end of the vane to rub against a surface of the spool as the vane rotates, thereby increasing the resistance to rotation of the spool.

21. The method of claim 16, further including the step of providing a plurality of damping vanes on said hub.

* * * * *